US010053815B2

(12) United States Patent
Tringale et al.

(10) Patent No.: US 10,053,815 B2
(45) Date of Patent: Aug. 21, 2018

(54) SYSTEM AND METHOD FOR ORGANIZING CLOTHING

(71) Applicants: Alison Tringale, Peachtree City, GA (US); Anthony Tringale, Peachtree City, GA (US)

(72) Inventors: Alison Tringale, Peachtree City, GA (US); Anthony Tringale, Peachtree City, GA (US)

( * ) Notice: Subject to any disclaimer, the term of this patent is extended or adjusted under 35 U.S.C. 154(b) by 559 days.

(21) Appl. No.: 14/633,678

(22) Filed: Feb. 27, 2015

(65) Prior Publication Data

US 2015/0322620 A1 Nov. 12, 2015

Related U.S. Application Data

(60) Provisional application No. 61/990,752, filed on May 9, 2014.

(51) Int. Cl.
*A41H 33/00* (2006.01)
*D06F 89/00* (2006.01)

(52) U.S. Cl.
CPC ..... *D06F 89/005* (2013.01)

(58) Field of Classification Search
CPC ..... D06F 89/005; D06F 89/02; D06F 89/023
USPC ..... 223/37, 38; 229/87.15–87.17; 493/405
See application file for complete search history.

(56) References Cited

U.S. PATENT DOCUMENTS

| | | | | |
|---|---|---|---|---|
| 4,421,500 | A * | 12/1983 | Smith | B43M 3/02 493/405 |
| 5,435,025 | A | 7/1995 | Gerard et al. | |
| 6,360,927 | B1 * | 3/2002 | Barker | D06F 89/02 223/37 |
| 6,685,065 | B1 * | 2/2004 | Ebling | D06F 89/02 223/37 |
| 6,814,269 | B1 * | 11/2004 | Fernandez | B65B 63/045 223/37 |
| 7,287,721 | B2 | 10/2007 | Quick et al. | |
| 9,022,259 | B2 * | 5/2015 | Breier | D06F 89/023 223/38 |
| 2002/0139140 | A1 | 10/2002 | Schaab | |
| 2004/0134167 | A1 | 7/2004 | Licari | |
| 2005/0237200 | A1 | 10/2005 | Bellum et al. | |
| 2006/0065680 | A1 * | 3/2006 | LaPace | D06F 89/02 223/37 |
| 2010/0213094 | A1 * | 8/2010 | McKay | D06F 89/005 206/494 |
| 2012/0298824 | A1 * | 11/2012 | West | F16B 2/205 248/316.7 |

* cited by examiner

*Primary Examiner* — Nathan Durham
(74) *Attorney, Agent, or Firm* — Kevin Keener; Keener and Associates P.C.

(57) ABSTRACT

The invention is directed toward a system and method for folding and organizing clothes. The system comprises a support base, a securing strap, and a roller. The securing strap is placed on the top surface of the support base. Clothing is placed on the top surface over the securing strap. The roller is rolled over the clothing and the clothing is wrapped around the roller. The roller engages the securing strap and causes the securing strap to wrap around the clothing and securely maintain the clothing in an organized roll. The support base may have a pair of foldable wings to permit a user to fold the sides of the clothing in prior to rolling up the clothing.

10 Claims, 10 Drawing Sheets

SYSTEM AND METHOD FOR ORGANIZING CLOTHING

PRIORITY

This application claims priority to U.S. Provisional Patent Application Ser. No. 61/990,752, filed May 9, 2014.

FIELD OF THE INVENTION

This invention pertains to items for organization and more particularly to a system and method for organizing clothing utilizing a foldable support, a roller, and a securing strap.

BACKGROUND OF INVENTION

Clothing is a common part of everyday society. Individuals like to look nice and have a clean appearance for others when in public. A large part of looking clean is having clean clothes. After clothes are washed they are stored for later wear. Often some clothes—such as shirts, dresses, and skirts—are hung on hangers to prevent the clothes from wrinkling. Other times some clothes are folded and stored in stacks in a dresser or wardrobe. However, over time, the clothes stored in a dresser often become disorganized and unfolded, causes them to become disheveled. This occurs even more frequently when the clothes are for children and the children put clothes away and retrieve them from the dresser. Therefore, what is needed is a system and method for storing clothes in a dresser which preserves the organization of the clothes and prevents unfolding and disheveling of the clothes when disturbed by a user.

SUMMARY OF INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward a system for folding clothes comprising a support base and one or more securing straps. The support base has a top side and a bottom side. The top side of the support base is substantially planar. The top side of the support base comprises one or more strap guides. The one or more securing straps may be placed over the one or more strap guides. In another embodiment the one or more securing straps have a first configuration and a second configuration. In the first configuration the one or more securing straps is substantially planar along the length of the one or more securing straps and has a substantially curved shape along the width of the one or more securing straps. In the second configuration the one or more securing straps is substantially spiral along the length of the one or more securing straps and has a substantially planar shape along the width of the one or more securing straps. In another embodiment the system may further comprise a roller which is substantially cylindrical. Furthermore, the roller may have a plurality of protrusions extending radially from the cross-sectional profile of the roller. In another embodiment, the roller further comprises handles positioned at each end of the roller.

In another embodiment the support base has an internal perimeter defining a support base handle opening. The support base may further comprises one or more feet protruding from the surface of the bottom side of the support base. The support base may further comprises a right edge and a left edge. The right edge is hingedly connected to a right foldable wing. The right foldable wing has a top side and bottom side opposite the top side. The right foldable wing is configured to hingedly rotate around the hinged connection to position the top side of the right foldable wing within proximity of the top side of the support base. The left edge is hingedly connected to a left foldable wing. The left foldable wing has a top side and bottom side opposite the top side. The left foldable wing is configured to hingedly rotate around the hinged connection to position the top side of the left foldable wing within proximity of the top side of the support base. In another embodiment the right foldable wing has an internal perimeter defining a right foldable wing handle opening and the left foldable wing has an internal perimeter defining a left foldable wing handle opening. When the left foldable wing the right foldable wing are positioned in a closed position over the support base the left foldable wing handle and the right foldable wing handle are in substantial alignment with the support base handle opening.

The invention is also directed toward a method of organizing clothes comprising placing one or more securing straps on a strap guide on a top side of a support base, ensuring the one or more securing straps are in the first configuration, placing an article of clothing over the support base and the one or more securing straps, placing a roller on top of the article of clothing, wrapping one end of the article of clothing around the roller, rolling the roller from one end of the article of clothing to the other end, applying pressure to the support base and the one or more securing straps, and applying enough pressure to the one or more securing straps to cause the one or more securing straps to transition into the second configuration, causing the one or more securing straps to wrap around the outer circumference of the article of clothing. The method may further comprise, prior to applying the roller, folding in the edges of the article of clothing by hingedly rotating a right foldable wing and a left foldable wing hingedly connected to the support base.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Figure 1:
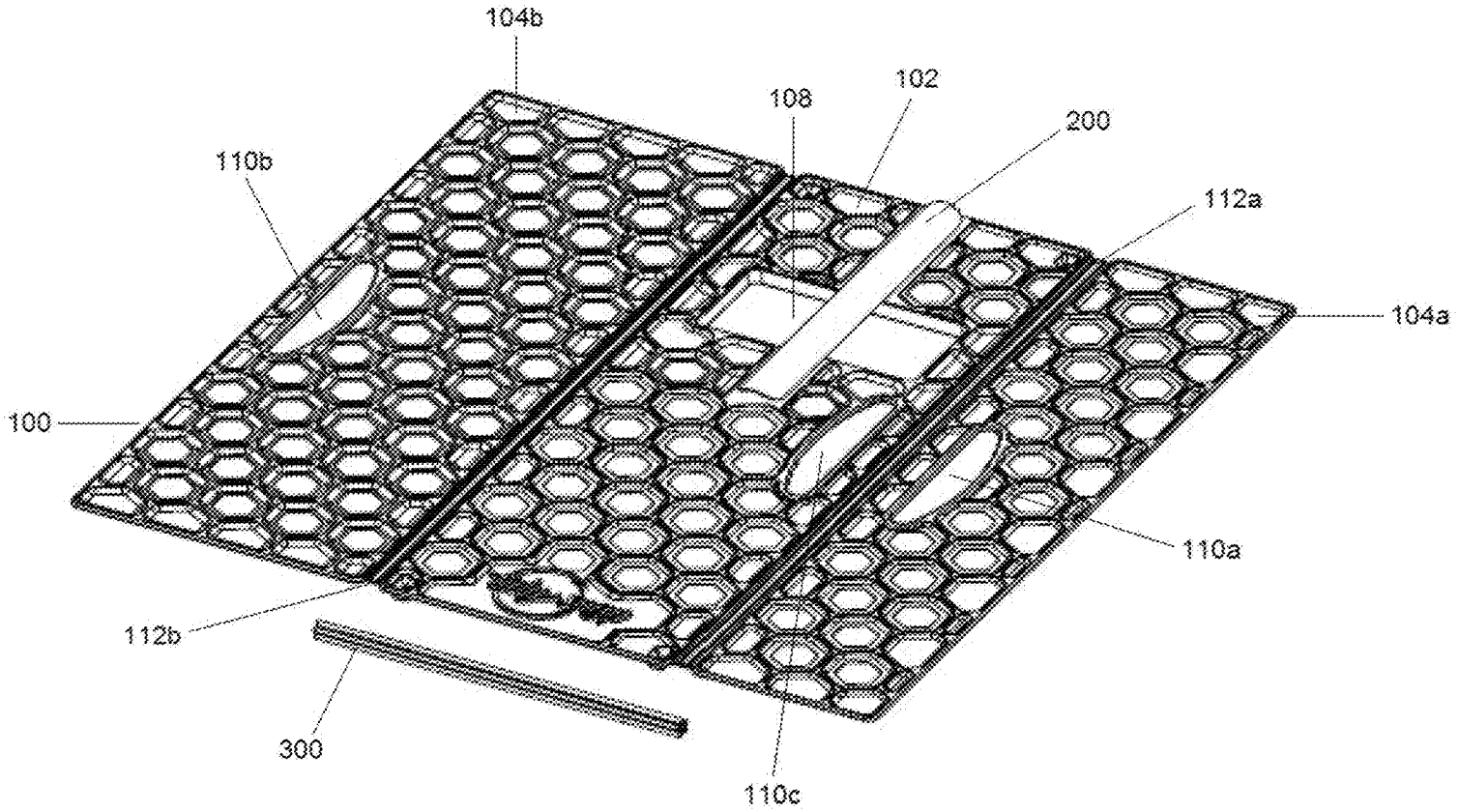
FIG. 1 is a perspective view of the system.

The invention is directed toward a system for folding and rolling clothes. Referring to FIG. 1 the system comprises a support base 100, a securing strap 200, and a roller 300. The support base 100 is a substantially rigid, planar surface over which clothes are placed while being folded and rolled. The support base 100 comprises a central support base 102. The central support base 102 provides the substantial support for the clothing, the securing strap 200, and the roller 300, during the rolling process. The central support base 102 has a trap 108. The trap 108 is a recessed area within the central support base 102. The trap 108 is configured such that the securing strap 200 sits transversely over the trap 108 during use. In the preferred embodiment, the central support base is substantially rectangular in shape with a right edge and a left edge. In the embodiment shown the right edge terminates into a right hinge 112*a*, and the left edge terminates into a left hinge 112*b*. The right hinge 112*a* is connected to a right foldable wing 104*a* and the left hinge 112*b* is connected to a left foldable wing 104*b*. The right hinge 112*a* and left hinge 112*b* may be any type of hinge permitting the rotation of the right foldable wing 104*a* and the left foldable wing 104*b*. The right hinge 112*a* and left hinge 112*b* may be a metal hinge, a plastic hinge, a flexible material, or any other type of device or material permitting the right foldable wing 104*a* and left foldable wing 104*b* to hingedly rotate over the central support base 102.

Figure 4:
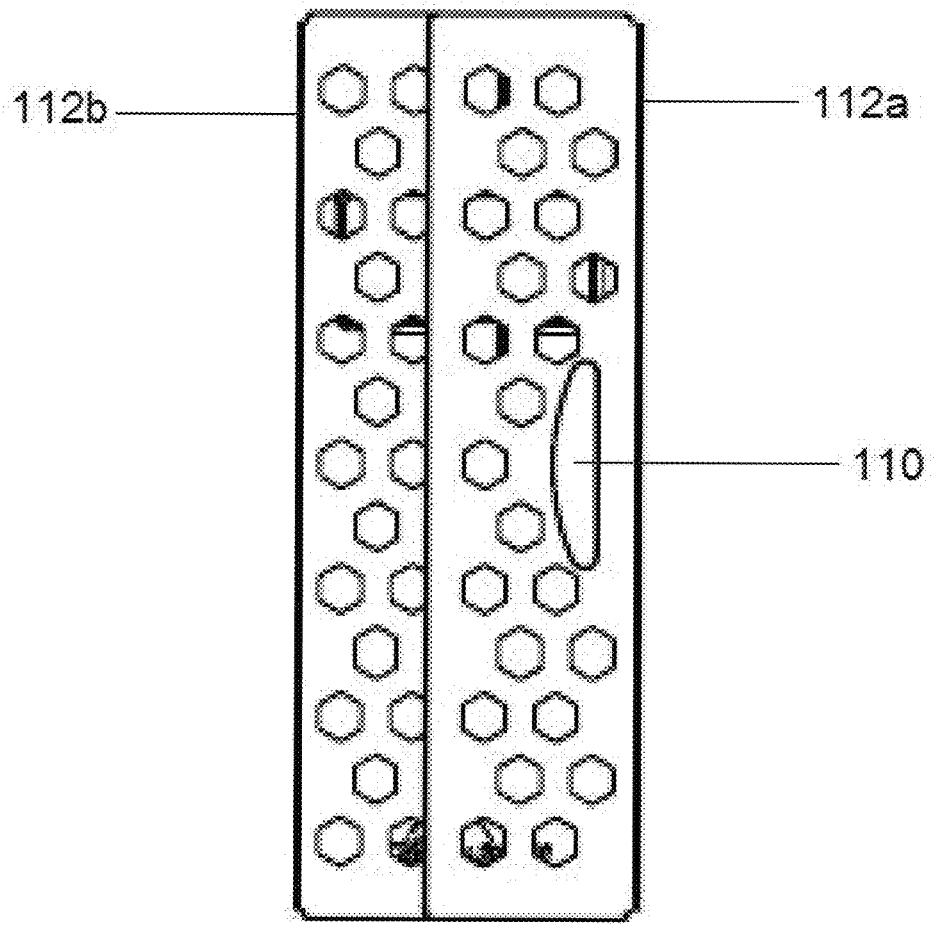
FIG. 4 is a top view of the support base.

In one embodiment, the right foldable wing 104*a* has a right foldable wing handle opening 110*a*, the left foldable wing 104*b* has a left foldable wing handle opening 110*b*, and the central support base 102 has a support base handle opening 110*c*. When the right foldable wing 104*a* is hingedly rotated over top of the central support base 102 and the left foldable wing 104*b* is hingedly rotated over the top of the central support base 102, the right foldable wing handle opening 110*a* and the left foldable wing handle opening 110*b* align with the support base handle opening 110*c* to form a single handle 110, as shown in FIG. 4. The handle 110 permits a user to easily carry the support base 100 by hand from one location to another.

Figure 2A:
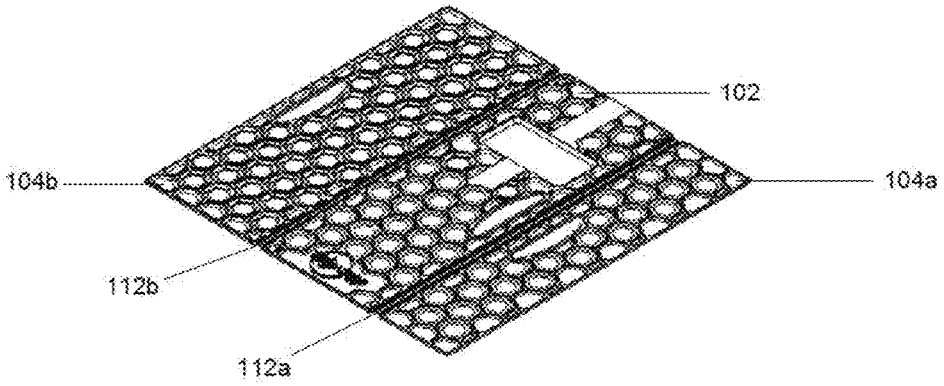
FIG. 2*a* is a perspective view of the support base.
Figure 2B:
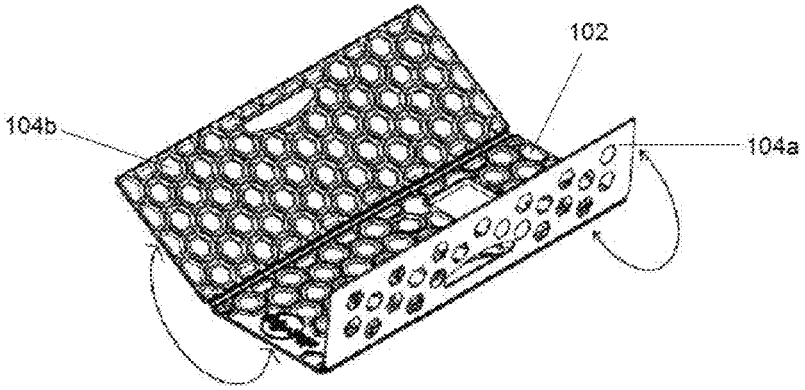
FIG. 2*b* is a perspective view of the support base.
Figure 2C:
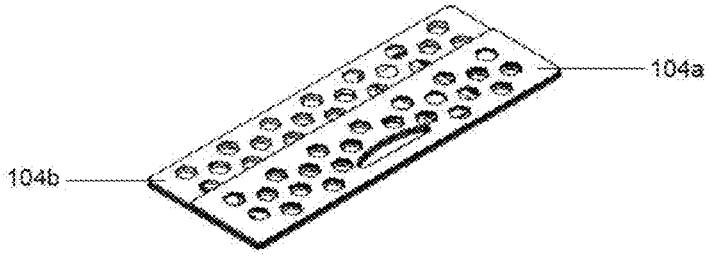
FIG. 2*c* is a perspective view of the support base.
Figure 5A:
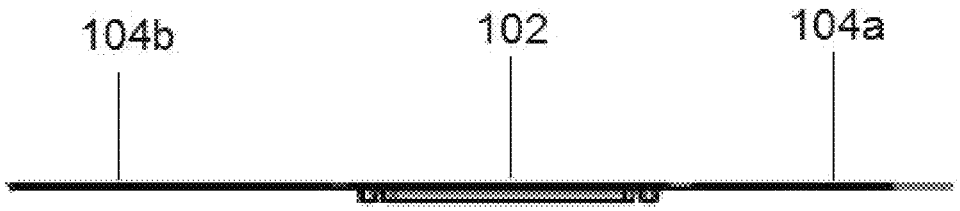
FIG. 5*a* is an end view of the support base.
Figure 5B:
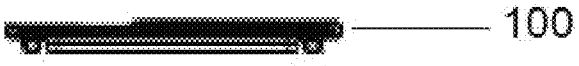
FIG. 5*b* is an end view of the support base.

Referring to FIG. 2*a*-2*c*, the folding of the right foldable wing 104*a* and the left foldable wing 104*b* are displayed. As shown in FIG. 2*a*, when in the open configuration, the right foldable wing 104*a* and the left foldable wing 104*b* are in a substantially planar alignment with the central support base 102. As shown in FIG. 2*b*, the right foldable wing 104*a* hingedly rotates along the right hinge 112*a* so that the top surface of the right foldable wing 104*a* may come in contact with top surface of the central support base 102. The left foldable wing 104*b* hingedly rotates along the left hinge 112*b* so that the left foldable wing 104*b* may come in contact with top surface of the central support base 102. Lastly, as shown in FIG. 2*c*, the right foldable wing 104*a* and left foldable wing 104*b* are both folded in on top of the central support base 102. In the embodiment displayed the right foldable wing 104*a* is positioned on top of the left foldable wing 104*b*. In other embodiments the left foldable wing 104*b* may be positioned on top of the right foldable wing 104*a*. An end view of the unfolded configuration is displayed in FIG. 5*a*. An end view of the folded configuration is further displayed in FIG. 5*b*.

Figure 3:
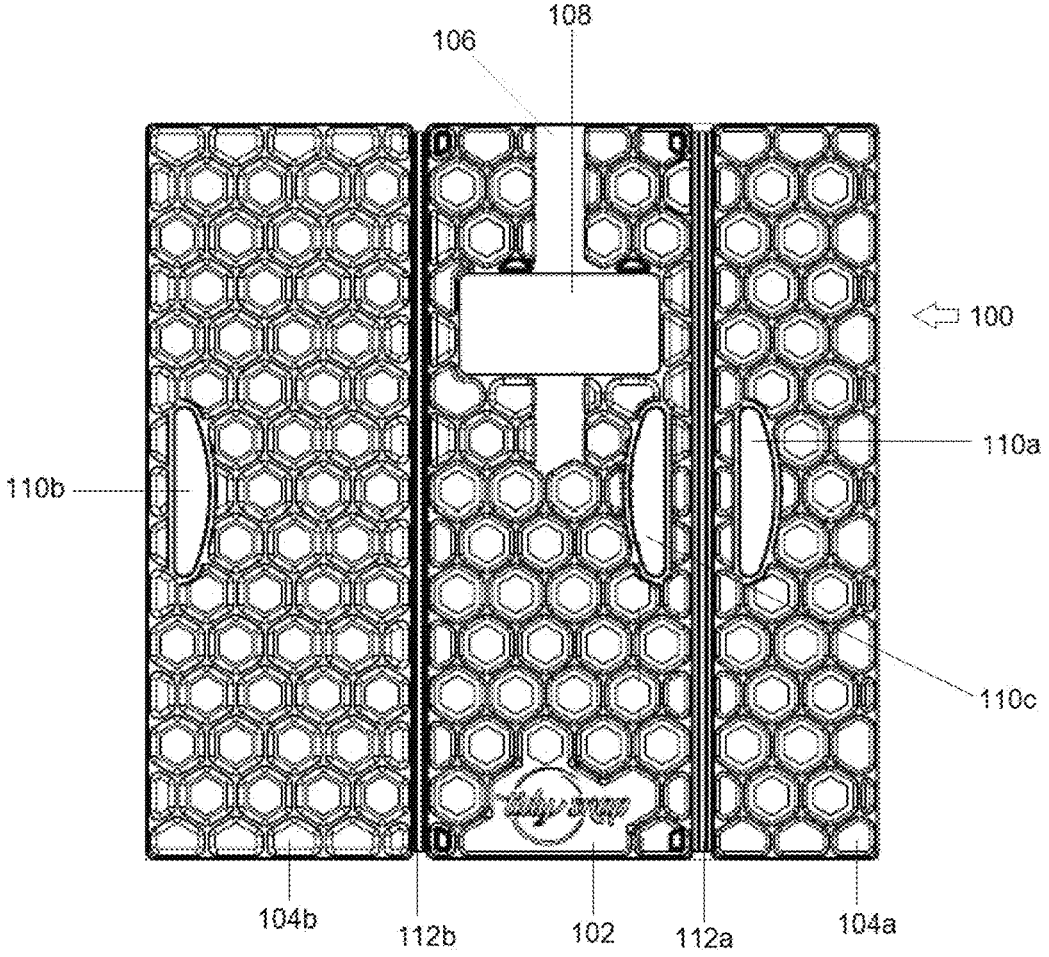
FIG. 3 is a top view of the support base.

Referring to FIG. 3, a top view of the support base 100 is displayed. In the embodiment displayed, the central support base 102 may further comprise a strap guide 106. The strap guide 106 is a section of the central support base 102 on which the securing strap is configured to be positioned during use. The strap guide 106 may be a recess in the top surface of the central support base 102 or may be a design on the top surface of the central support base 102 designed to guide a user in the proper positioning of the securing strap 200. In the displayed embodiment the strap guide 106 transversely crosses the trap 108. In other embodiments the strap guide 106 does no cross the trap 108 but guides a user in the proper positioning of the securing strap 200 over the trap.

Figure 6A:
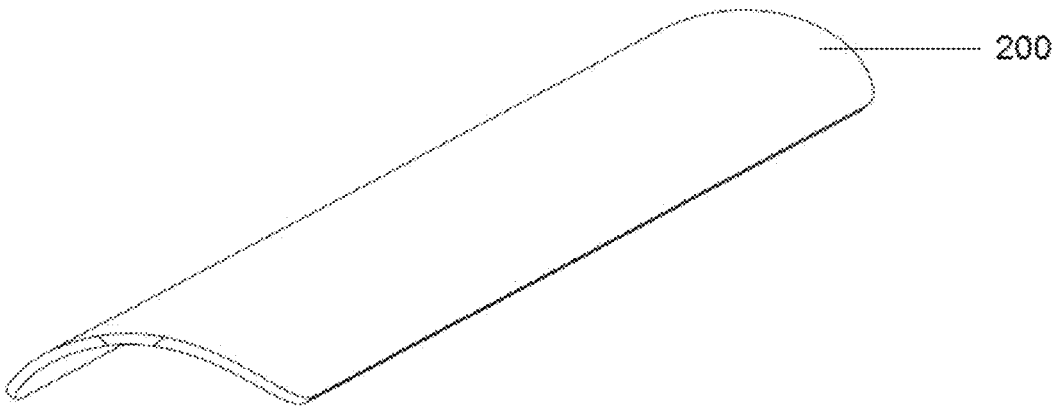
FIG. 6*a* is a perspective view of the securing strap.
Figure 6B:
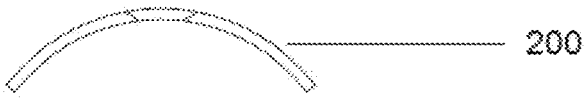
FIG. 6*b* is an end view of the securing strap.
Figure 7A:
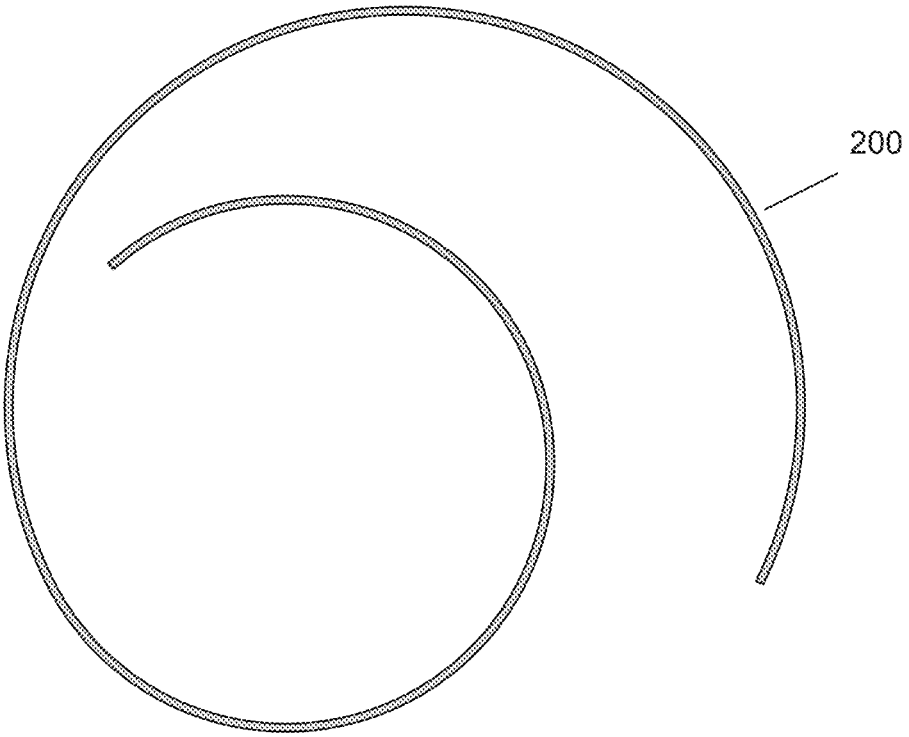
FIG. 7*a* is a side view of the securing strap.
Figure 7B:
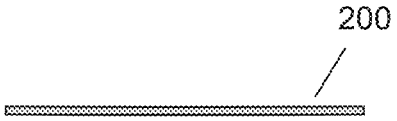
FIG. 7*b* is an end view of the securing strap.

Referring to FIG. 6*a* and FIG. 6*b*, the preferred embodiment of the securing strap 200 is displayed. In the preferred embodiment the securing strap 200 is self-locking strap more commonly known as a "snap-bracelet". In the preferred embodiment the securing strap 200 has a first configuration and a second configuration. As shown in FIGS. 6*a* and 6*b*, the first configuration of the securing strap 200 is displayed. In the first configuration, the securing strap 200 is substantially planar along the length of the securing strap 200, as displayed in FIG. 6*a*. The securing strap 200 also has a substantially curved shape along the width of the securing strap 200, as displayed in FIG. 6*b*. FIGS. 7*a* and 7*b* display the second configuration of the securing strap 200. In the second configuration, the securing strap 200 is substantially spiral along the length of the securing strap 200 as shown in FIG. 7*a*. As shown in FIG. 7*b*, the securing strap 200 has a substantially planar shape along the width of the securing strap 200 in the second configuration.

Figure 8A:
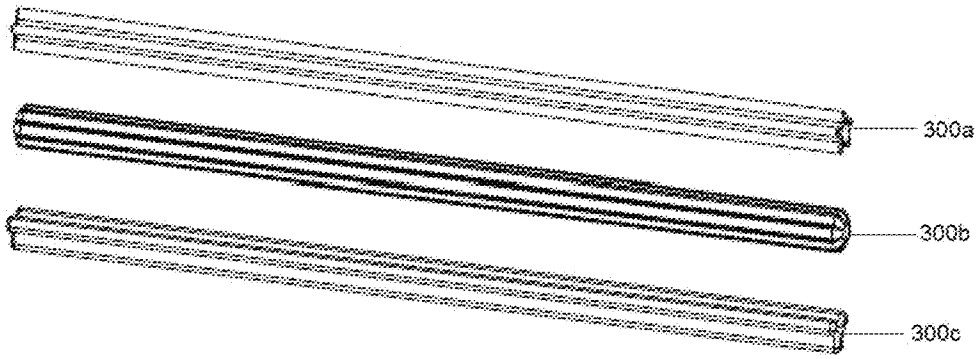
FIG. 8*a* is a perspective view of different embodiments of the roller.
Figure 8B:
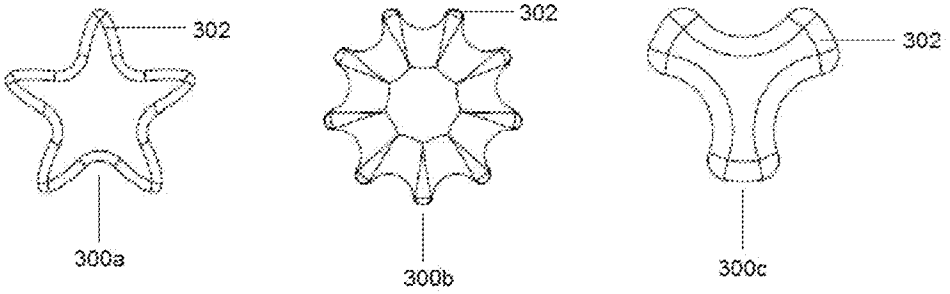
FIG. 8*b* is an end view of different embodiments of the roller.

Different configurations of the roller 300 are displayed in FIG. 8*a* and FIG. 8*b*. The roller 300 is substantially cylindrical, as displayed in FIG. 8*a*. The configurations displayed differ in the profile shapes of the rollers, as displayed in FIG. 8*b*. In the preferred embodiment, the roller 300 has a plurality of protrusions 302. The protrusions 302 extend radially from the cross-sectional profile of the roller 300. In the preferred embodiment each of the protrusions 302 extend along the entire length of the roller 300. In other embodiments the protrusions 302 may extend in a sections along the length of the roller, with gaps between each protrusion section. The roller may have any size, number, or shape of protrusions 302. For instance, in the embodiment designated 300*a*, the cross-sectional profile of the roller 300 is a five-pointed star with five protrusions 302 equally spaced radially. In the embodiment designated 300*b*, the cross-sectional profile of the roller 300 has nine protrusions 302 equally spaced radially. In the embodiment designated 300*c*, the cross-sectional profile of the roller 300 has three protrusions equally spaced radially. When in use the ends of the roller 300 may extend beyond width of the clothing, forming handles for use by the user. In another embodiment, each opposite longitudinal end of the roller 300 may terminate in a separate handle which is distinct from the body of the roller 300. The body of the roller 300 may rotate about its central axis while the handles are stationary while in use.

Figure 9:
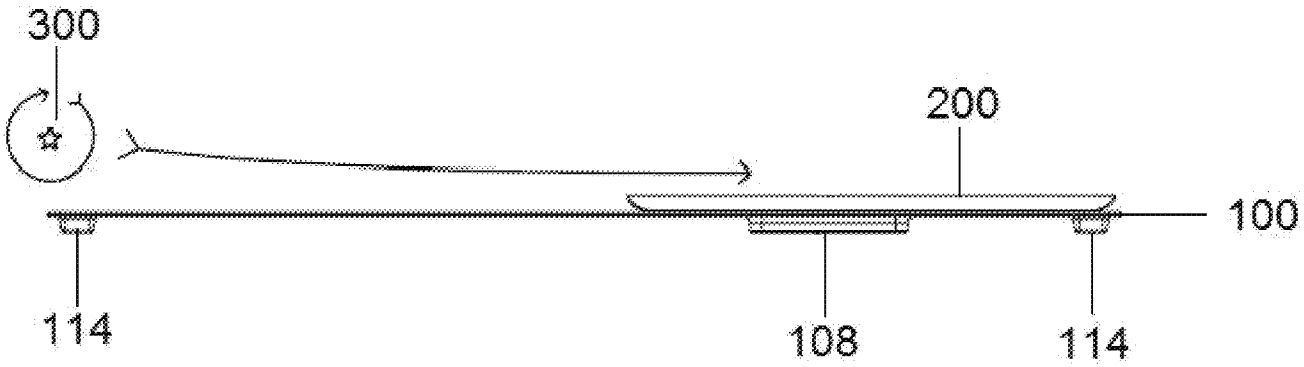
FIG. 9 is a side view of the system.

Referring to FIG. 9, a side view of the operation of the system is displayed. The support base 100 has a plurality of feet 114 extending from the bottom surface of the support base 100. The support base 100 rests on the feet 114 while in use. The trap 108 also protrudes down from the bottom surface of the support base 100. A user places a securing strap 200 on the top surface of the support base 100. A user then places clothing on the top surface of the support base 100, covering the securing strap 200. The user may use the right foldable wing 104*a* and the left foldable wing 104*b* to fold in the sides of the clothing to make the clothing substantially rectangular. The user then applies the roller 300 to the proximal end of the clothing. The user wraps the proximal end of the clothing around the roller 300 and proceeds to roll the roller 300 along the clothing, continually wrapping the clothing around the roller 300. The roller 300 then engages the securing strap 200. The securing strap 200 is then wrapped along with the clothing around the roller 300. The securing strap 200 may then be fastened to itself or the clothing to firmly secure the clothing in a tight cylindrical shape for storage. If the securing strap 200 is "snap bracelet" type of securing strap 200, the securing strap 200 is in the first configuration when first placed on the support base 100. The roller 300 compresses the securing strap 200, causing a middle section to distend into the trap 108. The compression causes the securing strap 200 to change from the first configuration to the second configuration. The spiral shape of the second configuration causes the securing strap 200 to automatically wrap around the outer circumference of the clothing. The securing strap 200 maintains its second configuration, holding the clothing tightly in a rolled cylindrical shape.

Figure 10:
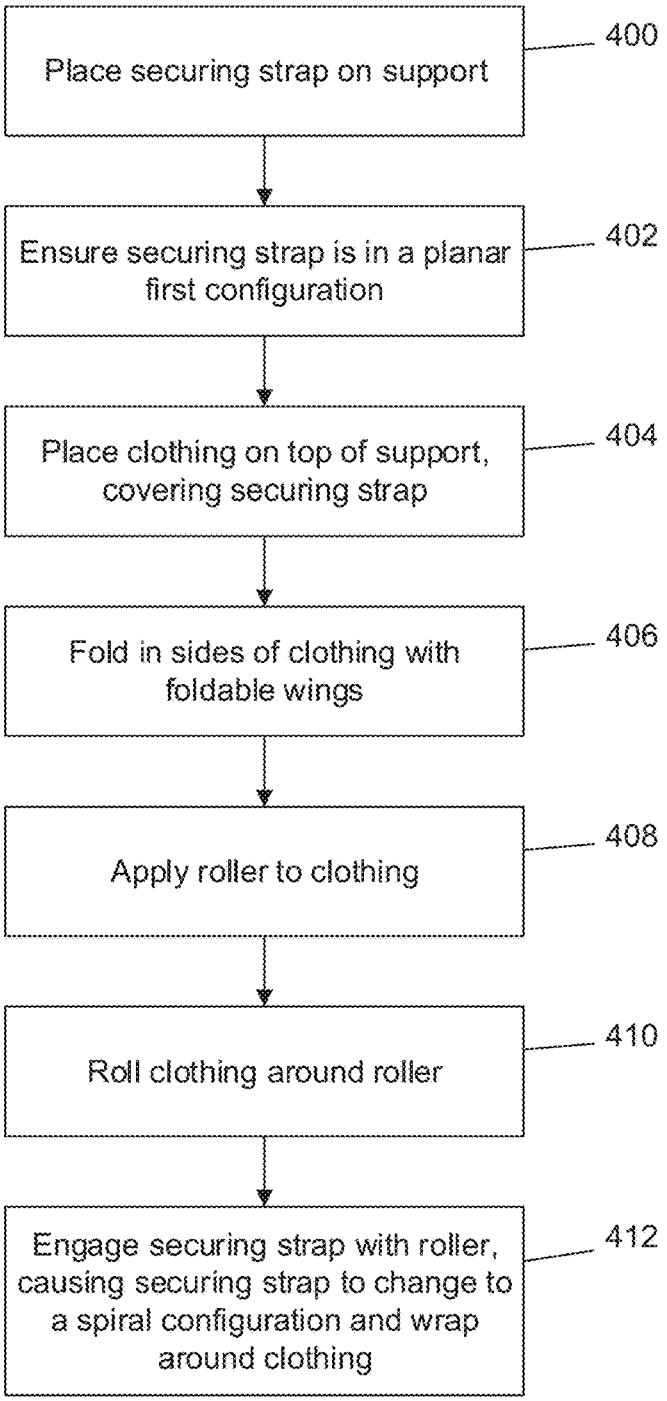
FIG. 10 is a schematic showing the method of utilizing the system.

Referring to FIG. 10, a flow diagram of the preferred method of utilizing the system is displayed. First the user places the securing strap on the support base 400. The user ensures the securing strap is in its planar first configuration 402. The user places the clothing on top of the support base, covering the securing strap 404. The user then folds in the sides of the clothing with the foldable wings 406. The user applies the roller to the clothing 408. The user wraps the clothing around the roller 408. The roller engages the securing strap, causing the securing strap to change to a spiral configuration and wrap around the clothing 412.

Once the clothing is rolled up into a cylinder shaped unit, the roller 300 may be removed by the user for use on another piece of clothing. Optionally the user may leave the roller within the rolled up clothing unit. The clothing unit may be easily stored within a dresser drawer or on a shelf with other clothing units. Preferably the clothing units can be set parallel to each other. To wear an item a user removes the clothing unit from the storage, removes the securing strap 200, and unrolls the clothing.

There may be several different embodiments of the system. In one embodiment the securing strap 200 may further have a means for securing the securing strap to itself or to the clothing. The securing means may consist of hook and loop tape, a snap, a button, a fastener, a hook and eye, a buckle, a zipper or any other means for removeably securing two components together. In other embodiments the securing means may permit the user to connect the securing strap 200 of one unit of clothing to the securing strap of a second unit of clothing.

In one embodiment of the invention the support base 100 is solely the central support base 102 without the right foldable wing 104*a* or the left foldable wing 104*b*. In another embodiment, the support base 100 may fold along a horizontal hinge that can be a crease, seam, or hinge extending across the central support base 102, the right foldable wing 104*a*, and the left foldable wing 104*b* so that clothing may be folded in half lengthwise prior to applying the roller 300.

The support base 100 can be constructed of any rigid or semi-rigid material, for example wood, plastic, metal, fabric with a rigid inserts, or other suitable material. The roller 300 can be constructed of any rigid or semi-rigid material, for example wood, plastic, metal, fabric with a rigid inserts, or other suitable material. The securing strap 200 can be constructed out of any type of flexible material, such as metal, plastic or fabric or a combination of said materials. In other embodiments, the securing strap 200 is not a "snap bracelet" type of securing strap 200 but is instead completely flexible, such as a string, a ribbon, or a band of fabric.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A system for folding clothes comprising a) a support base
  i) said support base having a top side and a bottom side;
  ii) wherein said top side of said support base is planar;
  iii) wherein said top side of said support base comprises one or more strap guides;

b) one or more securing straps
  i) wherein said one or more securing straps may be placed over said one or more strap guides;
  ii) wherein said one or more securing straps have a first configuration and a second configuration;
    (1) wherein in said first configuration
      (a) one or more securing straps is planar along the length of said one or more securing straps;
      (b) said one or more securing straps has a curved shape along the width of said one or more securing straps;
    (2) wherein in said second configuration
      (a) said one or more securing straps is spiral along the length of said one or more securing straps;
      (b) said one or more securing straps has a planar shape along the width of said one or more securing straps;

c) a cylindrical roller having a plurality of protrusions extending radially from a cross-sectional profile of said roller.

2. The system as in claim 1 wherein said roller further comprises handles positioned at each end of the roller.

3. A system for folding clothes comprising a) a support base i) said support base having a top side and a bottom side;

ii) wherein said top side of said support base is planar;

iii) wherein said top side of said support base comprises one or more strap guides;

iv) wherein said support base further comprises a right edge and a left edge;

v) wherein said right edge is hingedly connected to a right foldable wing;

(1) said right foldable wing having a top side and bottom side opposite said top side;

(2) wherein said right foldable wing is configured to hingedly rotate around said hinged connection to position said top side of said right foldable wing within proximity of said top side of said support base;

vi) wherein said left edge is hingedly connected to a left foldable wing (1) said left foldable wing having a top side and bottom side opposite said top side;

(2) wherein said left foldable wing is configured to hingedly rotate around said hinged connection to position said top side of said left foldable wing within proximity of said top side of said support base;

b) one or more securing straps i) wherein said one or more securing straps may be placed over said one or more strap guides.

4. The system as in claim 3 wherein said support base has an internal perimeter defining a support base handle opening.

5. The system as in claim 4 a) wherein said right foldable wing has an internal perimeter defining a right foldable wing handle opening;

b) wherein said left foldable wing has an internal perimeter defining a left foldable wing handle opening;

c) wherein when said left foldable wing is positioned in a closed position over said support base said left foldable wing handle is in substantial alignment with said support base handle opening;

d) wherein when said right foldable wing is positioned in a closed position over said support base said right foldable wing handle is in substantial alignment with said support base handle opening.

6. The system as in claim 5 a) wherein said one or more securing straps have a first configuration and a second configuration;

b) wherein in said first configuration i) one or more securing straps is planar along the length of said one or more securing straps;

ii) said one or more securing straps has a curved shape along the width of said one or more securing straps;

c) wherein in said second configuration i) said one or more securing straps is spiral along the length of said one or more securing straps;

ii) said one or more securing straps has a planar shape along the width of said one or more securing straps.

7. The system as in claim 6 further comprising cylindrical roller.

8. The system as in claim 7 wherein said roller has a plurality of protrusions extending radially from a cross-sectional profile of said roller.

9. The system as in claim 8 a) wherein said support base further comprises one or more feet;

b) wherein said one or more feet protrude from a surface of said bottom side of said support base.

10. The system as in claim 9 wherein said roller further comprises handles positioned at each end of the roller.

* * * * *